US007360929B2

(12) United States Patent
Pfund et al.

(10) Patent No.: US 7,360,929 B2
(45) Date of Patent: Apr. 22, 2008

(54) LUMINAIRE WITH MULTI-PURPOSE MOUNTING FEATURE

(75) Inventors: David Pfund, Woodbridge, CT (US); James A. Melling, New Haven, CT (US)

(73) Assignee: Sylvan R. Shemitz Designs, Inc., West Haven, CT (US)

( * ) Notice: Subject to any disclaimer, the term of this patent is extended or adjusted under 35 U.S.C. 154(b) by 0 days.

(21) Appl. No.: 11/402,358

(22) Filed: Apr. 11, 2006

(65) Prior Publication Data

US 2006/0232981 A1 Oct. 19, 2006

Related U.S. Application Data

(60) Provisional application No. 60/671,980, filed on Apr. 15, 2005.

(51) Int. Cl.
*F21V 21/02* (2006.01)
*F21S 8/00* (2006.01)

(52) U.S. Cl. ..... 362/368; 362/147; 362/370; 362/396; 362/432; 362/446; 248/51; 248/52

(58) Field of Classification Search ..... 362/127, 362/133, 134, 145, 147–150, 362, 364, 365, 362/368, 370, 371, 374, 375, 382, 389, 396, 362/432, 446, 457; 248/51, 52, 235, 247, 248/240.3, 250
See application file for complete search history.

(56) References Cited

U.S. PATENT DOCUMENTS

| | | | | |
|---|---|---|---|---|
| 4,164,009 | A * | 8/1979 | Maguire et al. | 362/127 |
| 4,217,629 | A * | 8/1980 | Russell | 362/147 |
| 4,449,168 | A * | 5/1984 | Ewing | 362/404 |
| 5,690,415 | A * | 11/1997 | Krehl | 362/125 |
| 6,467,928 | B2 * | 10/2002 | Crelin | 362/147 |
| 6,848,806 | B2 * | 2/2005 | Yoshida et al. | 362/147 |
| 2003/0227772 | A1 * | 12/2003 | Yoshida et al. | 362/147 |

* cited by examiner

*Primary Examiner*—Bao Q. Truong
(74) *Attorney, Agent, or Firm*—Cantor Colburn LLP

(57) ABSTRACT

A luminaire including a housing and a multi-purpose mounting feature formed at an interior of the housing, where the mounting feature is configured to receive and retain a mount for mounting of the luminaire on a vertical surface, and where the mounting feature is configured to receive and retain an electrical cord, to direct the electrical cord at least partially along a length of the luminaire, and to conceal the electrical cord from view.

20 Claims, 7 Drawing Sheets

LUMINAIRE WITH MULTI-PURPOSE MOUNTING FEATURE

CROSS-REFERENCE TO RELATED APPLICATION

This application is related to and claims the benefit of U.S. Provisional Patent Application Ser. No. 60/671,980 filed on Apr. 15, 2005, the entire contents of which are herein incorporated by reference.

BACKGROUND OF INVENTION (a) Field of Invention

The present invention relates generally to luminaires which are mountable on vertical surfaces. More specifically the invention relates to a multipurpose mounting feature for panel-mounted luminaires such as those used with partition panels in modular office furniture systems.

(b) Description of Related Art

Modular open office furniture systems incorporating a wide range of workstation partitions, worksurfaces, storage units, accessories and the like are well known and widely used where highly adaptable office workspaces that are easily rearranged and reconfigured are desired. The partition panels of such systems are typically configured to receive mountable worksurfaces, shelves, storage units and the like at a variety of positions, or alternatively to accept brackets that receive such units. A common technique for mounting such furniture units consists of the use of brackets that engage the modular panels and incorporate one or more upwardly-oriented, hook-like extensions or flanges that are, in turn, received in a compatibly and suitably fashioned slot or channel integral to the furniture component. Furthermore, by providing mountable furniture units that incorporate horizontally elongated (or continuous) mounting channels, flexibility is provided in the horizontal positioning of the unit with regard to the brackets and/or with regard to the partition panels.

Luminaires are often used in conjunction with conventional modular office furniture systems. Such luminaires may be task lights that direct their output in a downward direction only to illuminate work surfaces located below the luminaires, ambient lights that direct their output in an upward direction only to illuminate ceilings and give general lighting to the space, or task/ambient luminaires that provide both downward and upward directed light. These luminaires are often fashioned as elongated units suitable for use with linear type fluorescent lamps and are capable of providing broad areas of lighting for horizontal worksurfaces and associated partition panels. Nominal 1" diameter (T8) lamps are the most popular lamps for these applications, however, narrower ⅝" diameter (T5) lamps are gaining popularity due to their inherent energy efficiency and improved performance in smaller luminaires.

Luminaires are typically mounted to the workstation partition panels at positions above the workstation surfaces and may incorporate elongated mounting features (similar to their furniture unit counterparts) to advantageously provide for flexibility in the positioning of the luminaires with regard to their respective mounting brackets. However, unlike furniture units, the luminaires are electrical devices and are thus fitted with power cords in accordance with applicable codes that connect the luminaires to electrical power supply outlets disposed either integral to the workstation, in an adjacent wall, or in the floor below the workstation. Accordingly, it is desirable to conceal the cord exit of the luminaire and to route the cord in an inconspicuous manner to a location where it can be suitably and desirably managed down to or below the worksurface.

Modular open-office furniture systems generally offer cord management accessories that facilitate the routing of power cords vertically from the desktop (or from below the desktop) to elevated luminaires at certain locations in the workstation. Often, however, the luminaire cord exit location does not correspond to the preferred vertical cord management location. Thus, horizontal management of the cord along the length of the luminaire is required to deliver the cord to the vertical cord management location.

Horizontal management of the cord behind or atop the luminaire is commonly achieved using individual cord management clips affixed to the luminaire. These are installed in the field and often must be purchased separately in addition to the luminaire. Most commonly, a double-sided adhesive pad is employed to affix the cord management clips to the rear of the luminaire, thus making the clips difficult to remove once they are installed and rendering them virtually impossible to reposition or reuse in the event that the wire management requirements of the workstation change. Furthermore, managing the cord along the rear of the luminaire does not fully conceal the cord. Additionally, passage of the cord along the rear of the luminaire is often interrupted by the aforementioned luminaire brackets. That is, the bracket extending from the panel and mounted to the luminaire obstructs the cord as it traverses the rear of the luminaire. Thus, at the bracket locations, the cord must either be dropped downward from the luminaire and routed to the electrical outlet or wrapped over or under the bracket and then continued along the rear of the luminaire. Both of these options results in premature and undesired exposure of the cord and thus disadvantageously limit the cord management capabilities of the luminaire.

Therefore, a panel-mounted luminaire is desired that overcomes these disadvantages and offers improved luminaire mounting and cord management capabilities. Specifically, a luminaire is desired having a mounting feature that is flexible and adaptable to various modular designs, that is aesthetically pleasing to the user, that does not require excess accessory parts for cord management, and that maintains cost-effectiveness and ease of installation and reposition.

SUMMARY OF INVENTION

The invention generally provides a luminaire comprised of a housing and a multi-purpose mounting feature formed at an interior of the housing, where the mounting feature is configured to receive and retain a mount for mounting of the luminaire on a vertical surface, and where the mounting feature is configured to receive and retain an electrical cord, to direct the electrical cord at least partially along a length of the luminaire, and to conceal the electrical cord from view.

The invention also provides a method of mounting a luminaire on a vertical surface where the luminaire includes a power cord extending therefrom. The method generally comprises disposing the power cord in a channel formed at an interior of the luminaire, directing the power cord in a horizontal direction in the channel along a length of the luminaire, affixing a plurality of mounting brackets onto the vertical surface, and inserting the mounting brackets into the channel to support the luminaire, where the channel is configured such that the mounting brackets do not interfere with said directing of the power cord along the length of the luminaire.

The above discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE INVENTION

Figure 1:
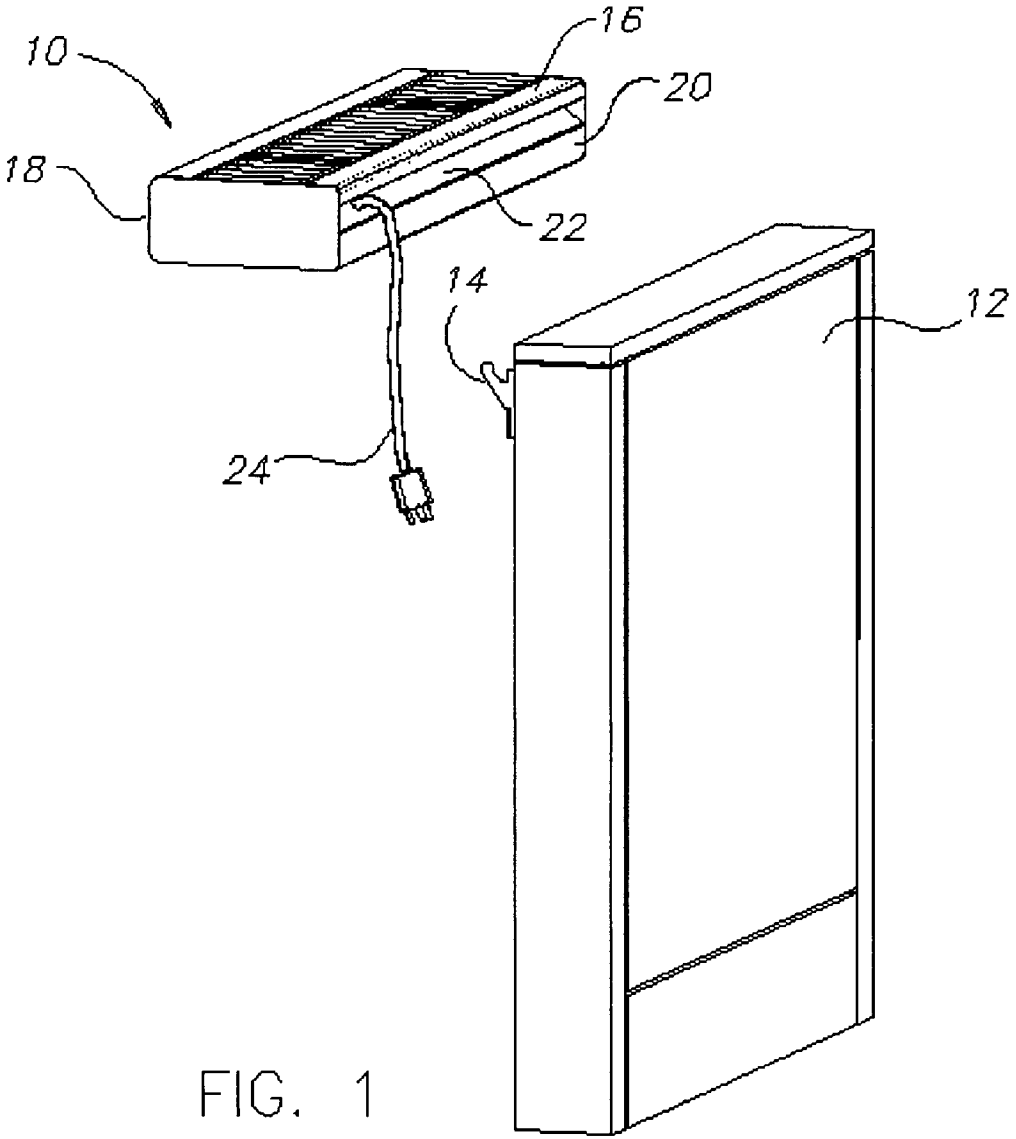
FIG. 1 is a perspective view of a panel-mountable workstation luminaire in a preferred embodiment of the invention.

FIG. 1 shows a perspective view of a workstation luminaire 10 in one embodiment of the invention. The luminaire 10 is configured, as will be discussed in detail herein, to be selectively mounted on a panel 12 by way of a mounting bracket 14. The panel 12 preferably forms a partition in a modular furniture system of the type often used in office settings.

The luminaire 10 comprises a housing 16 having a generally elongated rectilinear shape as shown, but may of course assume any desirable shape. In the embodiment of FIG. 1, the housing includes a front side 18, which remains visible when the luminaire 10 is mounted to the panel 12, and an opposite rear side 20 which is concealed against the panel 12 when the luminaire 10 is mounted thereon. The housing 16 further includes a multi-purpose mounting feature 22 formed integrally in the rear side 20 thereof. The mounting feature 22 extends continuously along a length of the rear side 20 and is designed, on the one hand, to receive and retain the bracket 14 for mounting of the luminaire 10 and, on the other hand, to conceal an electrical cord 24 which extends from the housing 16 and to horizontally direct the cord 24 as desired.

Figure 2:
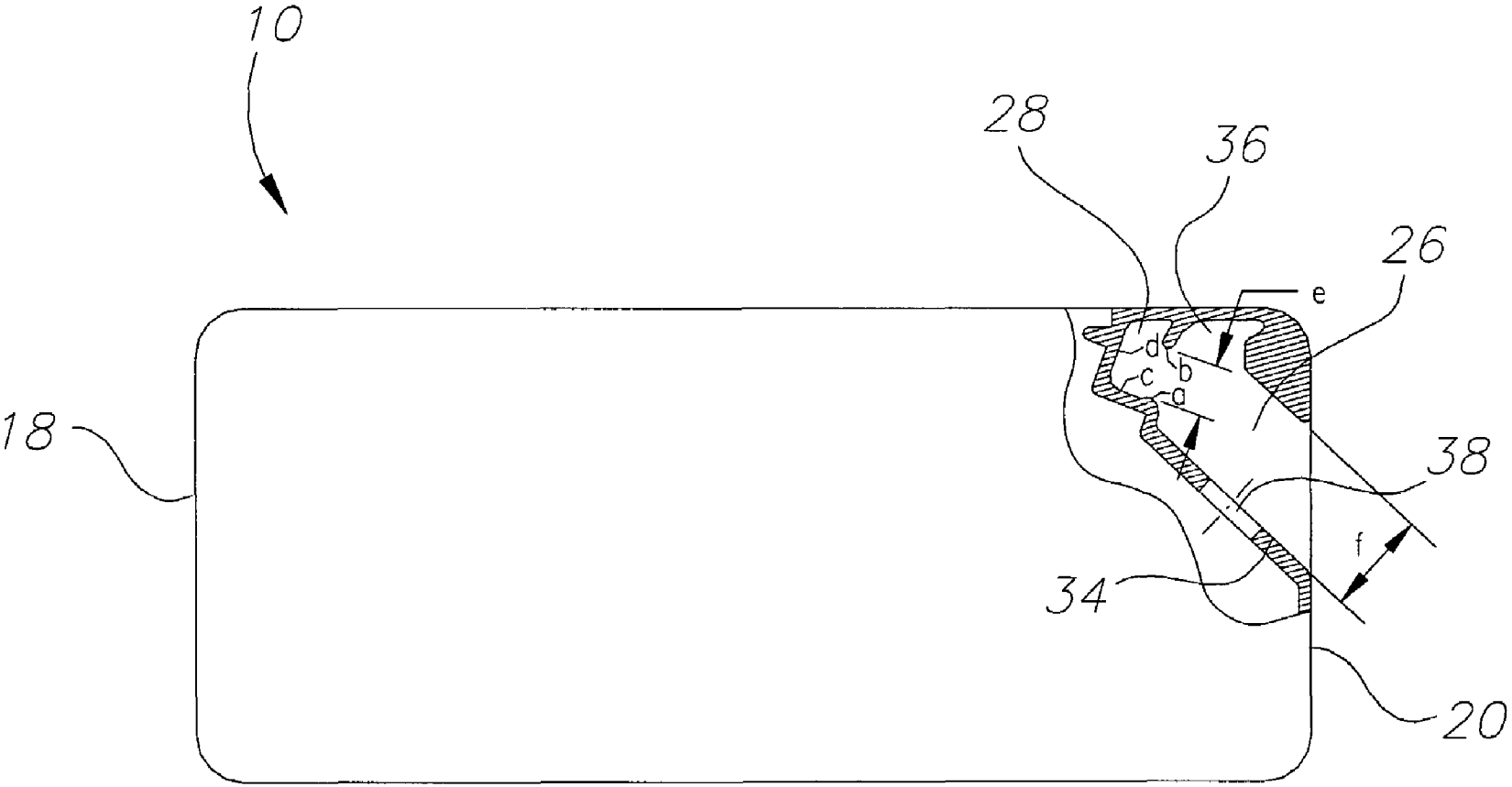
FIG. 2 is a side view, with partial cross-section, of the luminaire of FIG. 1.
Figure 3:
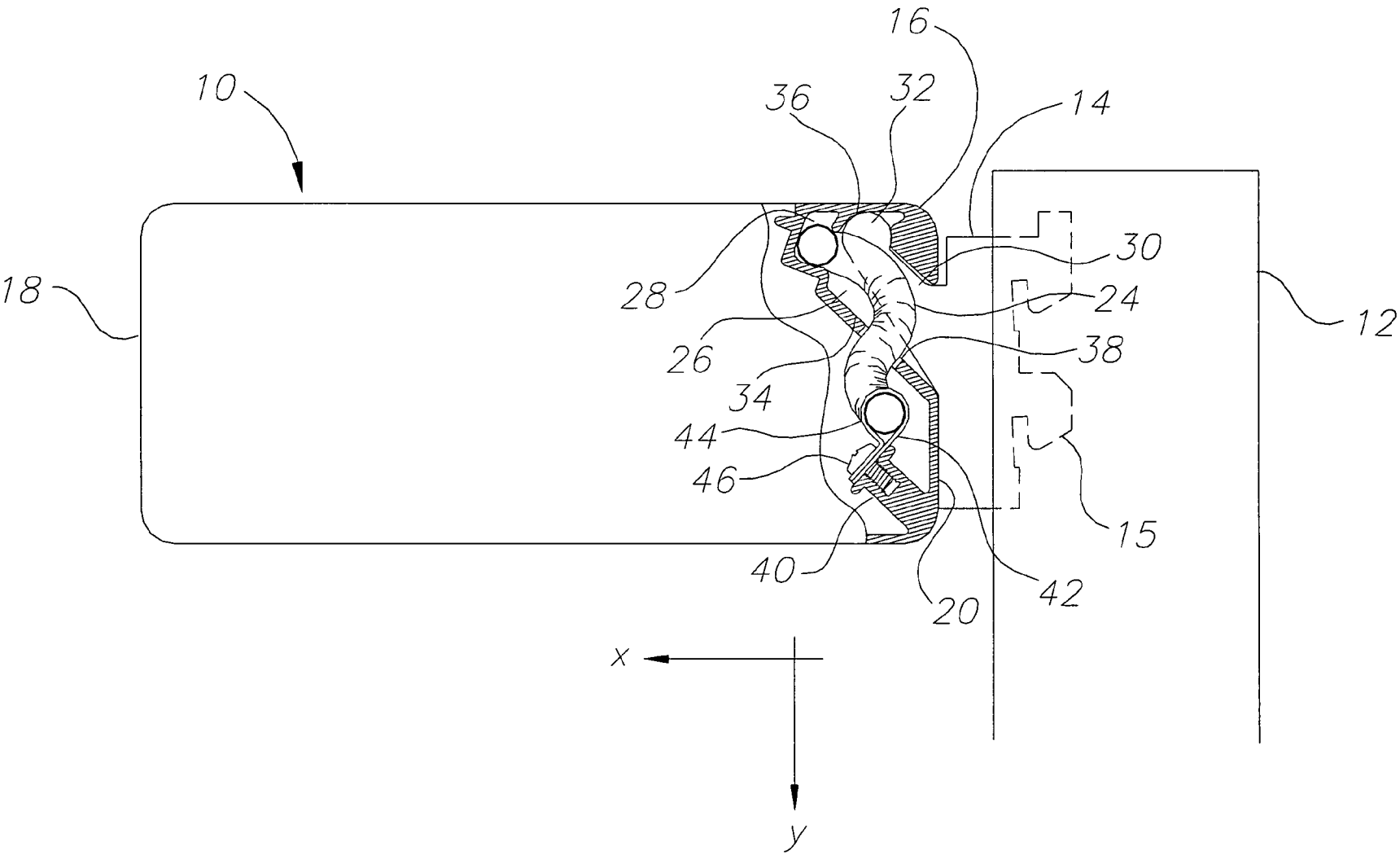
FIG. 3 is another side view, with partial cross-section, of the luminaire of FIG. 1 shown mounted to a partition panel.

FIGS. 2 and 3 are side views of the luminaire shown with partial cross-sectional cut-out portions to illustrate the features of the multi-purpose mounting feature 22. In cross-section, as shown, the mounting feature 22 generally comprises an upwardly oriented orifice which extends into the rear side 20 of the luminaire housing 16 and which is delimited by internal surfaces of the luminaire 10. This mounting feature 22 is generally composed of two contiguous, parallel channels: a mounting channel 26 and a cord management channel 28. The channels 26 and 28 extend over the length of the mounting feature 22 through an interior of the luminaire 10 in a direction generally parallel to the rear side 20.

Figure 5:
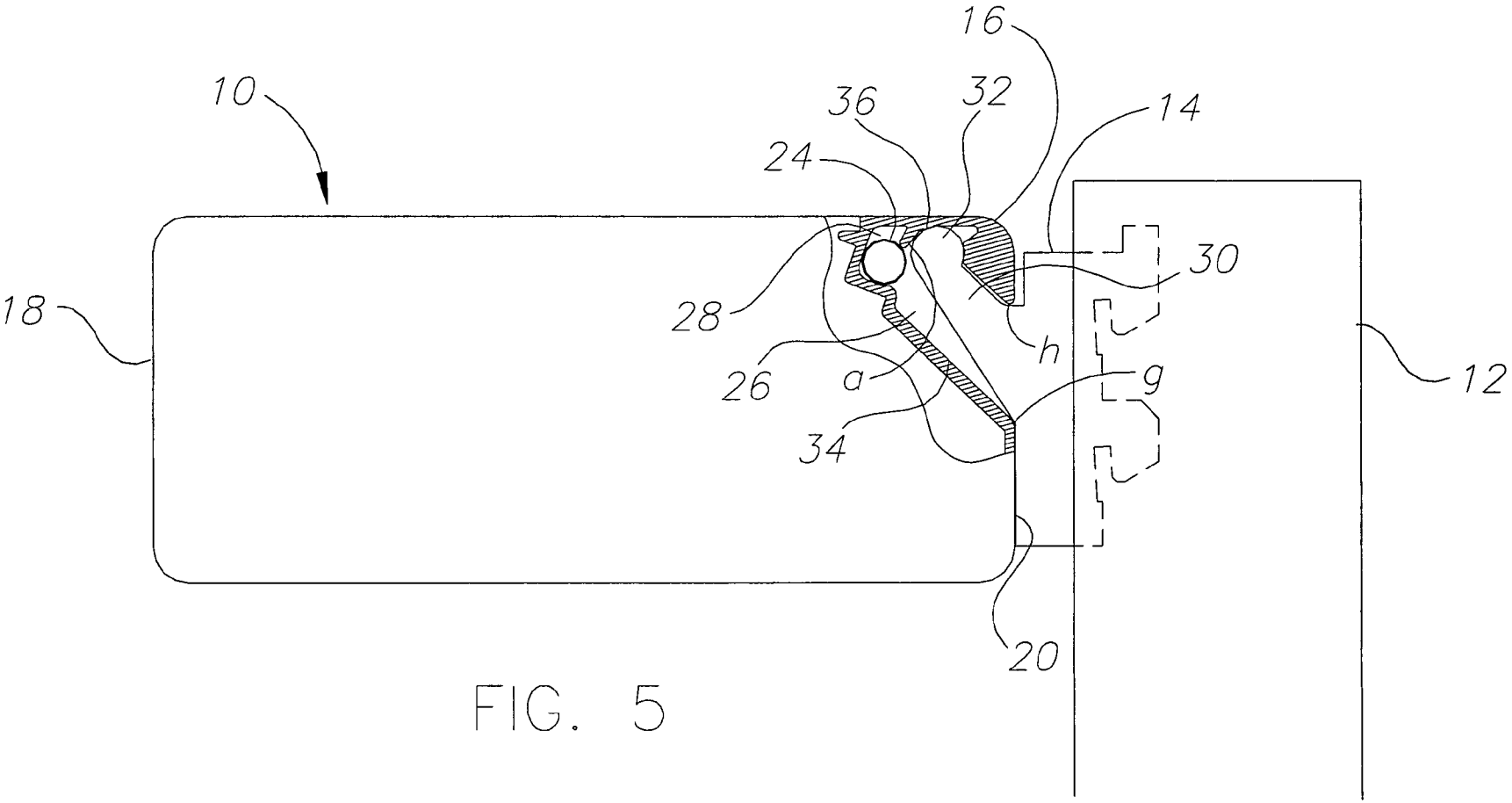
FIG. 5 is another side view, with partial cross-section, of the panel-mounted luminaire of FIG. 3.

The mounting channel 26 is generally shaped and configured to receive and retain the mounting bracket 14, as is particularly shown in FIGS. 3 and 5. In the present exemplary embodiment, the bracket 14 includes a neck 30 which extends in an upwardly angled direction relative to the panel 12. The bracket 14 further includes an integrally formed bulbous portion 32 disposed at an upper end of the neck 30. The mounting channel 26 includes a slot portion 34 which generally corresponds in cross-sectional shape to the neck 30 of the bracket 14. More generally, the slot portion 34 is configured to receive the bracket 14 and to align with the neck 30 when the luminaire 10 is mounted on the bracket 14. The mounting channel 26 further includes a notch portion 36 configured to receive the bulbous portion 32 of the mounting bracket 14 when the luminaire 10 is mounted thereon.

The mounting channel 26 and the bracket 14 together comprise an antidislodgement arrangement which prevents against displacement of the mounted luminaire 10 in x and y directions, as shown in FIG. 3. That is, when the mounting bracket 14 is fully received within the mounting channel 26, the slot portion 34 and the notch portion 36 bear against the neck 30 and the bulbous portion 32 of the bracket 14, respectively, such that movement of the luminaire 10 in the x direction and in the y direction is inhibited. The particular bracket shown also encounters both the rear side 20 of luminaire 10, and the top and bottom sides (surfaces) of slot 34 at points g and h proximate to the opening in rear side 20 of the luminaire 10 (see FIG. 5), such that displacement of the luminaire in the −x and −y directions is also prevented when the mounting bracket 14 is fully received in the mounting channel. Removal of the luminaire 10 from the bracket 14 is only achieved by pivoting the luminaire 10 upwardly about the bulbous portion 32 and then lifting the luminaire 10 off the bracket 14 in the upward direction.

The mounting channel 26 further includes a cord exit location 38 formed in the slot portion 34. The cord exit location 38 is an opening formed in the slot portion 34 through which the electrical cord 24 passes, as particularly shown in FIGS. 2 and 3. The opening of the cord exit location 38 comprises a shape generally corresponding to a cross-sectional shape of the cord 24. Alternatively, the opening may comprise a slot of any suitable shape or configuration as desired and may be elongated in a direction parallel to an axis of the mounting channel 26 and/or transverse thereto. Notably, the cord exit location 38 is disposed on the rear side 20 of the luminaire housing 16 and is concealed within the multi-purpose mounting feature 22. The cord exit location 38 is disposed at any position along the length of the mounting feature 22, as desired. That is, the exit location 38 is disposed at any position across the length of the rear side 20 of the luminaire housing 16.

Forces acting on the electrical cord 24 external to the luminaire 10 during use may accordingly damage, fatigue or otherwise compromise primary wiring connections (splices) through the luminaire 10. To resist these forces that may be otherwise transferred to the wiring connections, the luminaire 10 may include a strain relief fitting, e.g., a squeeze type fitting, at cord exit location 38, or another type of strain relief fitting may be included internal to the luminaire.

Further concerning the mounting channel 26, a width f thereof is generally sized to facilitate reception and retention of the bracket 14 and, as will be discussed herein further, to allow the electrical cord 24 to pass from the exit location 38 to the cord management channel 28 and, moreover, to allow a person mounting the luminaire 10 to manually access the cord management channel 28. In the present exemplary embodiment, the width f is approximately 0.25-0.75 inches and, more specifically, is approximately 0.56 inches.

The cord management channel 28, as mentioned, is contiguous with and extends parallel to the mounting channel 26. The channels 26 and 28 are contiguous in that they share an opening e delimited by surfaces a and b, as particularly shown in FIG. 2. The cord management channel 28 is parallel to and extends along the entire length of the mounting channel 26. The opening e between the channels 26 and 28 correspondingly extends the length of the channels.

The cord management channel 28 is generally configured to concealingly receive and retain the electric cord 24 that exits the luminaire 10 at the exit location 38 and is further configured to concealingly direct the cord 24 in a horizontal direction as desired. The cord management channel 28 may have any desired cross-sectional shape suitable to receive, retain, and direct the cord 24. For example, the cross-sectional shape of the channel 28 may be substantially circular, rectilinear, curvilinear, or any desired combination thereof. In a preferred embodiment, as particularly shown in FIG. 2, the cross-section of the cord management channel 28 is irregularly shaped and is composed of both straight and curved line portions. The channel 28 cross-section includes surfaces a, b, c, and d which are arranged generally tangent to a circle equivalent in diameter to a diameter of a cross-section of the electrical cord 24. Here, in this exemplary embodiment, the diameter of the cord 24, and the diameter of the circle formed by surfaces a, b, c, and d, is approximately 0.20-0.40 inches and, more specifically, is approximately 0.310 inches, and corresponds to the type of power cord dictated by recognized safety standards for luminaires of the type disclosed herein. As mentioned above, the surfaces a and b delimit an opening e which traverses the length of the cord management channel 28. The opening e is configured to be slightly smaller than the cross-sectional diameter of the cord 24. In the present exemplary embodiment, the size of the opening e, that is, the distance from the surface a to the surface b, is approximately 0.185-0.350 inches and, more specifically, is approximately 0.295 inches. Alternatively, as discussed further herein below, the size of the opening e may be substantially equivalent to the cross-sectional diameter of the cord 24. When configured as such, intrinsic deformity characteristics of the cord 24 act to retain the cord 24 within the channel 28. See additional description below.

In use, as will now be discussed, the multi-purpose mounting feature 22 allows the luminaire 10 to be mounted as desired to the panel 12 by way of the mounting bracket 14 and further allows the cord 24 to be horizontally directed in an entirely concealed manner along all or a portion of the length of the luminaire 10.

In assembling the luminaire of the invention, the bracket 14 is first mounted to the panel 12. The bracket 14 includes panel mounting portions 15 which are configured to be received and retained in corresponding mounting slots formed in the panel 12. See, e.g., FIGS. 3 and 5. These portions 15 are first inserted into the panel 12 to thus mount the bracket 14 thereon. Additional brackets 14 are similarly mounted on the panel 12 as desired. Preferably, two brackets 14 are used for each luminaire 10. A first bracket 14 is mounted on the panel 12 corresponding generally to one end of the luminaire 10 and a second bracket is mounted on the panel 12 with respect to an opposite end of the luminaire 10. Of course, additional brackets 14 may be used as desired. For example, a third bracket 14 may be mounted onto the panel 12 at a location generally corresponding to the middle of the luminaire 10. Generally, at least two brackets 14 are mounted on the panel 12 in a horizontally aligned, i.e., level, position.

Prior to mounting the luminaire 10 on the brackets 14, the electric cord 24 is concealed within the cord management channel 28 and directed to an approximate cord drop location. The cord drop location is where the installer desires the cord 24 to extend downwardly from the luminaire 10 toward the worksurface. Advantageously, this may be at any position along the luminaire 10.

The electric cord 24 is generally flexible in nature, as best depicted in FIG. 3, and characteristically is composed of a pliant and resilient protective outer jacket. Thus, the electric cord 24 can be routed into the mounting channel 26 by bending the cord 24 in a direction toward the channel 26 as the cord 24 exits the concealed cord exit location 38. The electric cord 24 is then continued through the mounting channel 26 toward the cord management channel 28. The electric cord 24, once reaching the cord management channel 28, is pressed between protrusions a and b to thus enter the channel 28 through the opening e. The pliant outer jacket of the cord 24 is slightly compressed upon entering the opening e due to the dimension of e being slightly smaller than the cross-sectional diameter of the cord 24, as discussed above. Once fully within the channel 28, the slightly compressed cord 24 resiliently recovers to its original cross-sectional size and shape and thus engages the surfaces a, b, c, and d, as shown in FIG. 3 to seat securely within the cord management channel 28. Since this non-compressed cross-sectional size of the cord 24 is larger than the opening e, the cord 24 is thus removably retained within the channel 28. To remove the cord 24 from the channel 28, the cord 24 is simply pulled back through the opening e. The cord 24 is compressed again as it passes between surfaces a and b and is then released thereby into the mounting channel 26 wherein the cord 24 recovers to its original non-compressed diameter. In essence, the cord management channel 28 allows for a secure press-fit of the cord 24 into the channel 28 and selective removal therefrom as desired.

When inserted into the cord management channel 28 as such, the electrical cord 24 is directed along the length of the luminaire 10 in an entirely concealed manner. That is, the cord 24 is held within the multi-purpose mounting feature 22 at the cord management channel 28 completely out of view from the front side 18 of the luminaire 10.

A sufficient amount of the cord 24 is inserted into the cord management channel 28 such that the remaining non-inserted portion of the cord 24 emerges from the channel 28 and from the mounting channel 26 proximate to the desired cord drop area 50. See, FIGS. 4 and 6. The exact position of the cord drop can be adjusted and altered during and after the mounting of the luminaire on the brackets 14 to precisely locate the cord drop 50.

With the cord 24 properly inserted into the cord management channel 28, the luminaire 10 is ready for mounting on the brackets 14 previously placed on the panel 12 and extending therefrom. The luminaire 10 is lowered onto the mounting brackets 14 such that each bracket 14 is received and retained within the multi-purpose mounting feature 22. That is, each bracket 14 enters the mounting channel 26 and seats therein such that the neck 30 and the bulbous portion 32 of the brackets 14 align with the slot portion 34 and the notch portion 36, respectively, of the channel 26. Thus, the brackets 14 are engaged with the luminaire 10 in the above-discussed antidislodgement relationship, i.e., movement in the (±)x and (±)y directions is inhibited.

Since the mounting feature 22 extends continuously along the entire length of the rear side 20 of the luminaire 10, the brackets 14 may be conveniently inserted into the mounting channel 26 at any location along the length thereof. Once mounted on the brackets 14, the luminaire 10 may be adjusted in the horizontal direction to position the luminaire 10 relative to the panel 12 and/or to align the cord drop location, as desired. That is, the antidislodgement feature of the luminaire 10 acts to inhibit movement in the x and y directions but allows movement in the (±)z direction (see, e.g., FIG. 6). The continuous extension of the mounting feature 22 also allows the brackets to be mounted on the panel 12 in any desired disposition relative to the length of the luminaire 10. That is, the brackets 14 are receivable within the mounting feature 22 when the brackets 14 are regularly or irregularly spaced on the panel 12 relative to the length of the luminaire 10. The brackets 14 need not be aligned with specific mounting holes on the luminaire. Instead, the brackets 14 may be simply inserted at any point along the mounting feature 22.

Figure 4:
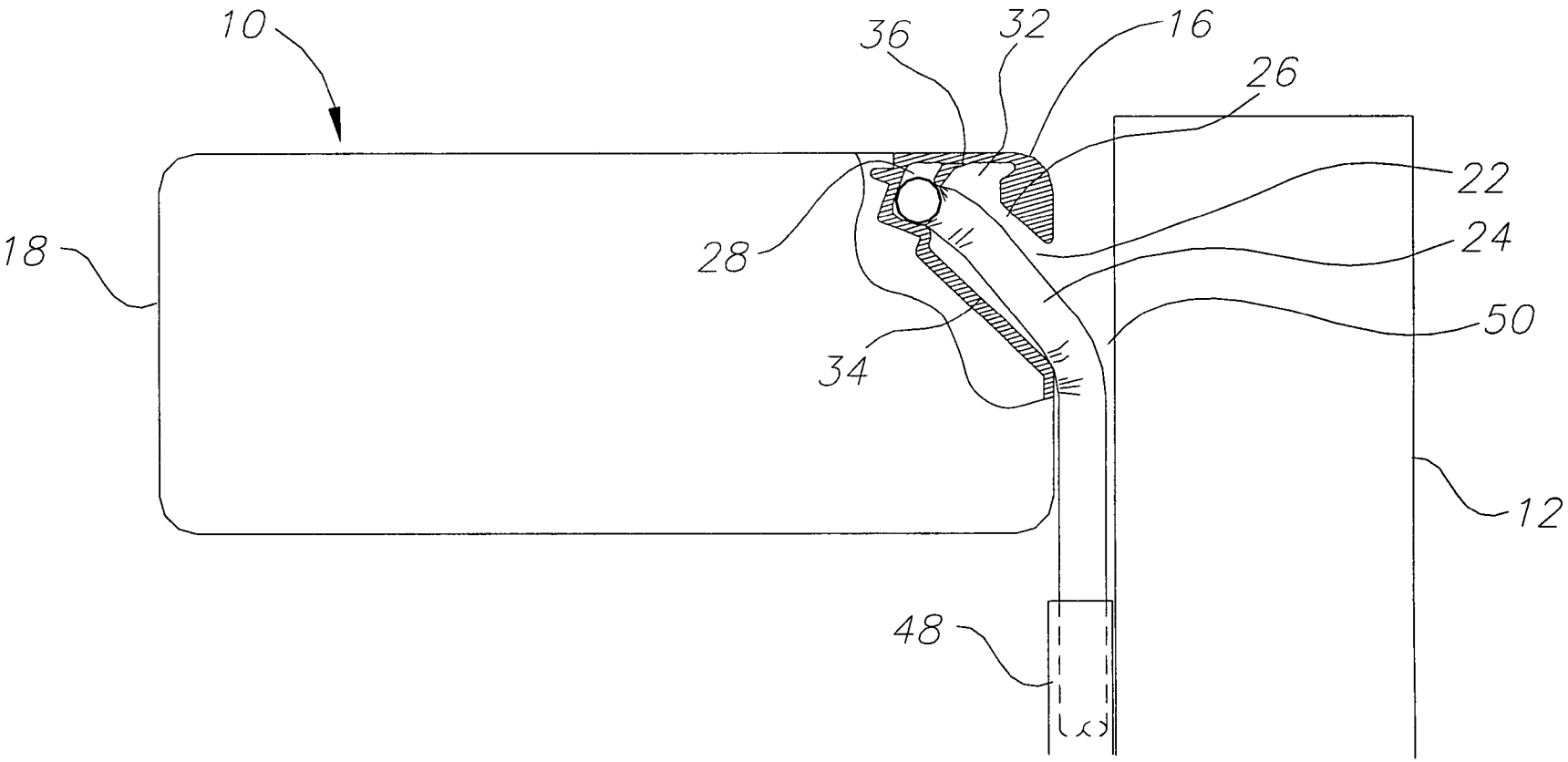
FIG. 4 is another side view, with partial cross-section, of the panel-mounted luminaire of FIG. 3.

In this way, the luminaire 10 is mounted on the panel 12 with the electrical cord 24 descending therefrom at the cord drop location 50. An exemplary dropping of the cord 24 is shown in FIG. 4. Therein, the cord 24 exits the cord management channel 28 at a specific cord drop location 50 and descends through the mounting channel 26 and then extends from the mounting feature 22 to hang downwardly from the luminaire 10. The electric cord 24 then may be routed through a commercially available vertical cord manager accessory 48, as desired, and directed downward to the worksurface or beyond to be plugged into an electrical outlet.

Advantageously, the cord management channel 28 allows the electric cord 24 to entirely bypass the mounting brackets 14. FIG. 5 shows another side view of the mounted luminaire 10 with a partial cross-section cut-away portion illustrating the path of the cord 24 relative to an adjacent mounting bracket 14. The mounting channel 26 which receives and retains the bracket 14 is distinct from the cord management channel 28 such that the cord 24 seated in the channel 28 clears the bracket 14. That is, the cord 24 does not engage the bracket 14 whatsoever nor does the cord 24 have to be routed around the bracket 14. Instead, the cord 24 disposed within the cord management channel 28 simply passes the bracket 14 adjacent to the bulbous portion 32. The cord 24 is separated from the bulbous portion 32 by a protrusion which defines, at its lower limit, the surface a and which is shared by the cord management channel 28 and by the notch portion 36 of the mounting channel 26. Thus, the cord management channel 28 allows the cord 24 to be directed, without hindrance or inconvenience, past the bracket 14.

Figure 6:
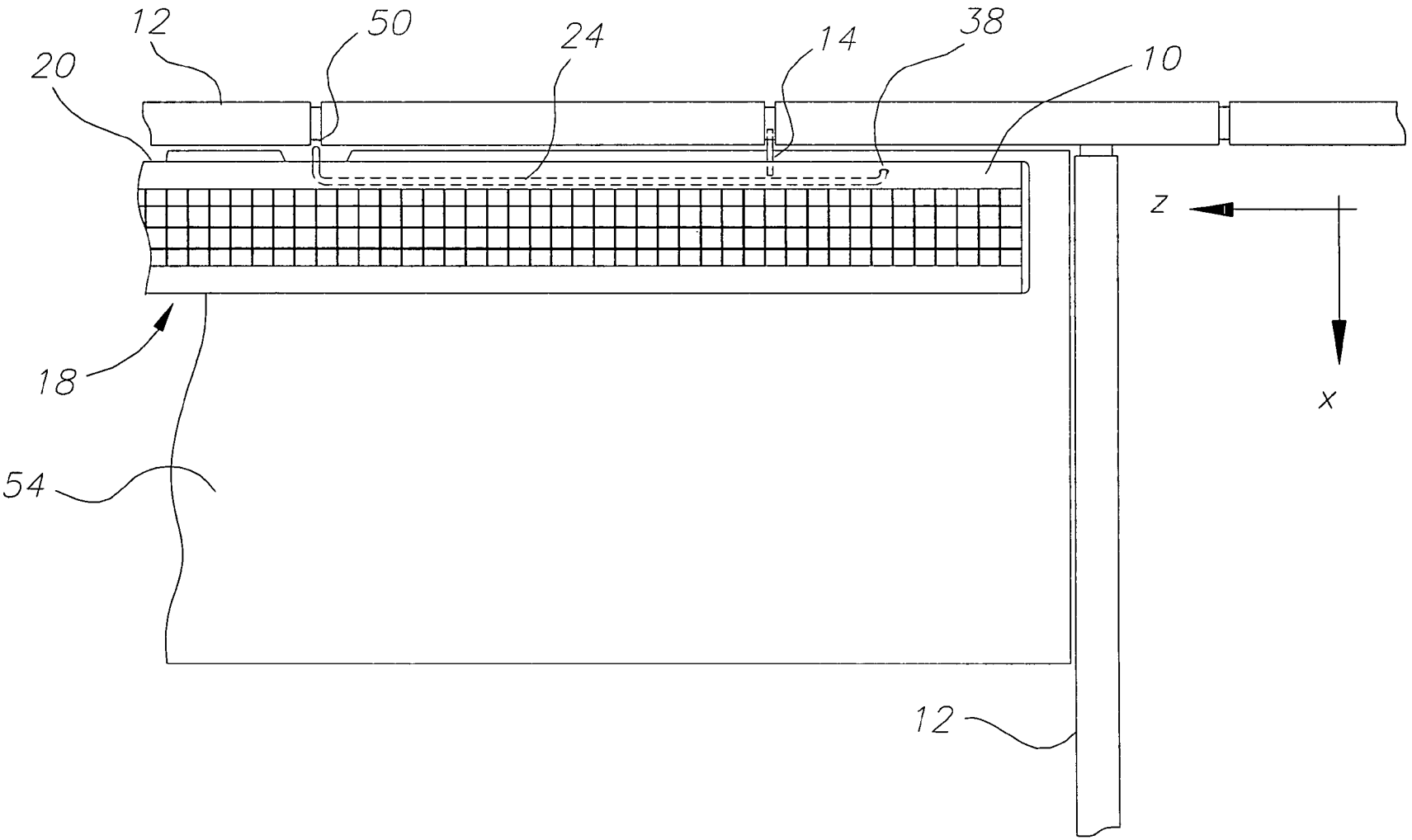
FIG. 6 is a partial plan view of the panel mounted luminaire of FIG. 3 atop a worksurface.

FIG. 6 shows a top view of the luminaire 10 mounted to the panel 12 above a work surface 54. The cord 24 is routed from the cord exit location 38 into the cord management channel 28 (not shown) and then directed horizontally in the z direction along part of the length of the luminaire 10. The cord 24 traverses unobstructed past the bracket 14 to the cord drop location 50 where the cord 24 leaves the channel 28 and descends downwardly from the mounting feature 22 and hence from the luminaire 10. As previously mentioned, the cord drop location 50 may be at any position along the length of the luminaire 10. Alternatively, rather than descend in a downward direction from the luminaire 10, the cord 24 may enter or traverse through the panel 12 at the cord drop location. That is, the cord 24 may extend from the cord management channel 28 at the cord drop location 50 and travel through the mounting channel 26 to the rear side 20 of the luminaire 10 where the cord 24 may enter a cut-out or the like in the panel 12. The cord 24 may progress through the panel to an opposite side thereof or may be routed internally within the panel. In this way, the cord 24 is not visible whatsoever beneath the luminaire 10. In any event, the cord 24 is completely concealed within the luminaire 10 as the cord 24 travels in the horizontal z direction. That is, cord management channel 28 holds the cord 24 within the interior of the luminaire out of view.

The embodiments discussed herein of the luminaire, brackets, and panel of the present invention are provided purely by way of example and in no way limit the scope of the invention.

While the brackets 14 were discussed herein as including the neck and bulbous portions 30 and 32, brackets 14 of other dimensions and profiles are contemplated so long as the brackets 14 sufficiently engage the luminaire 10 at the multi-purpose mounting feature 22 to suitably support the luminaire 10. Such brackets that also provide the above-discussed anti-dislodgement feature are desirable.

Figure 7:
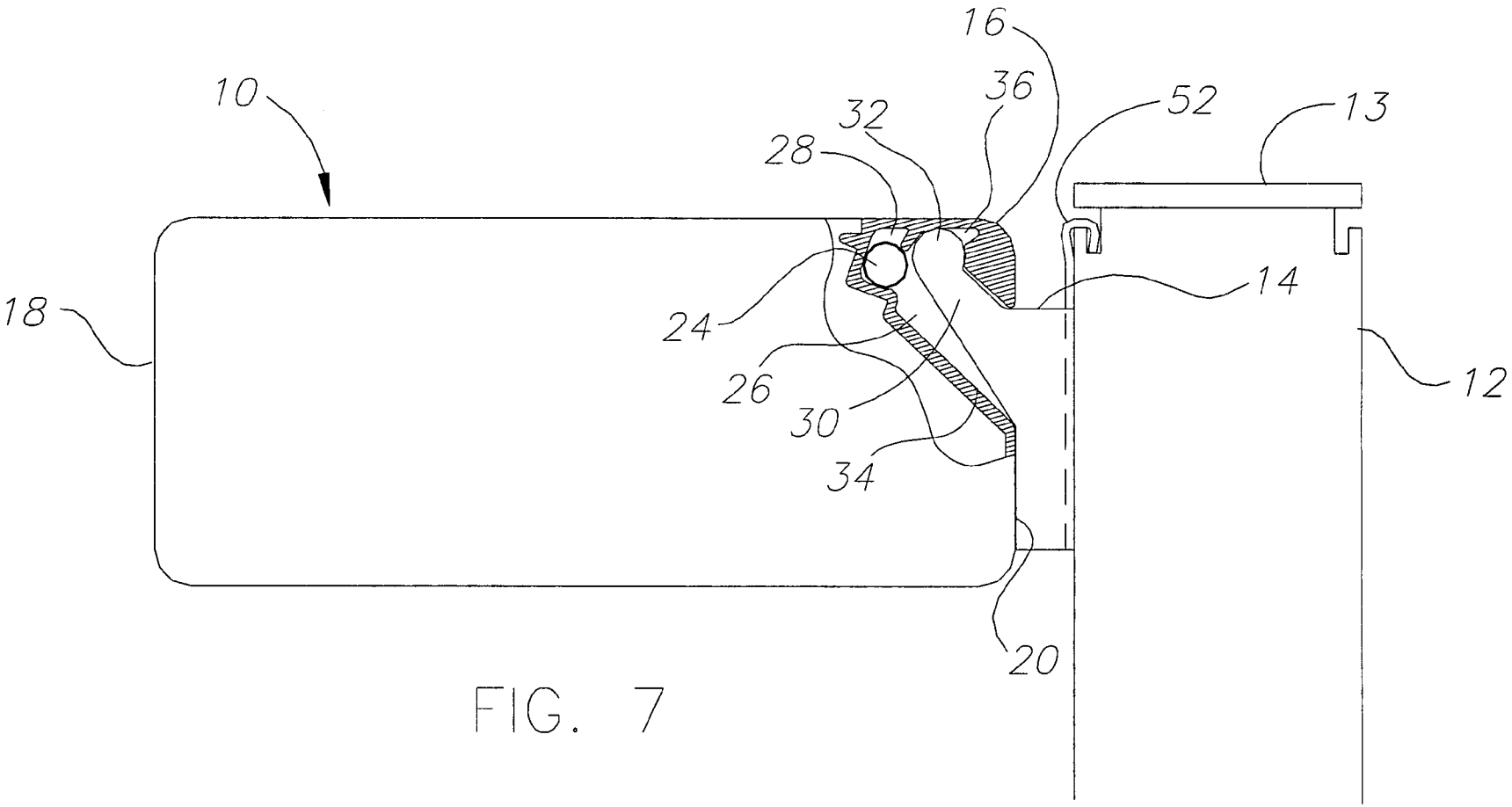
FIG. 7 is a side view, with partial cross-section, of a panel-mounted luminaire in another embodiment of the invention.

Similarly, the mounting brackets 14 are described herein by way of example as including the mounting portions 15 insertable into the panel 12 for mounting the brackets 14 thereon, as illustrated in FIGS. 4 and 5. Other means may be used to affix the brackets 14 to the panel 12. For example, the brackets 14 may include hangers 52 extending therefrom, as shown in FIG. 7. The hanger 52 extends upwardly from the bracket 14 and removably engages a lip of the panel 12 to thus affix the bracket 14 thereon. Accordingly, the panel 12 may include a separable top cap 13 that can be removed to allow insertion of the bracket 14 onto the panel lip and that, once reinstalled at the top of panel 12, prevents the inadvertent dislodgement of the bracket 14 from the panel 12. Alternatively, the mounting portion of bracket 14 may comprise one or more flanges for mounting the bracket 14 fixedly to the panel 12 or to a rigid vertical surface (such as a wall) by way of fasteners such as screws, etc. These and other means and methods may be used to mount the brackets 14 on the panel 12.

Similarly, in the absence of panel 12, bracket 14 may be (permanently or removably) fixed to, or formed integrally with, one or more column-like upright stanchion support members coincident with the rear side of the luminaire and which may (or may not) provide a means for routing the cord vertically down from the luminaire. Since the mounting feature 22 extends preferably continuously along the entire length of the rear side of the luminaire, the installer is provided with a range of where the upright(s) can be positioned. Moreover, by advantage of the described cord management channel, the position of the upright is not determined by the cord exit location as the cord can be conveniently managed horizontally and out of sight to any upright location. Specific details of the invention further allow the cord to be disposed into the upright (or a vertical cord management feature thereof) at a point on either side of the bracket component of the upright without interfering with the insertion of the bracket into the multipurpose mounting slot. In this exemplary embodiment, the upright may be a hollow member having an interior through which the cord may be discretely routed downward toward the worksurface. Alternatively, for this purposes, the upright may include the external vertical cord management feature alluded to above.

The mounting feature 22 is described herein as comprising mounting and cord management channels 26 and 28 disposed parallel and contiguous to one another. It will be understood that the mounting channel comprises any space configured to receive and retain the bracket 14 and is not limited to the particular descriptions set forth herein. Similarly, the cord management channel shall be broadly understood to encompass a pathway or the like internal to the luminaire which both conceals the electrical power cord extending from the luminaire and horizontally directs the cord. Additionally, the cord exit location 38 has been thus described as disposed in the mounting channel 26. However, it is noted that the exit location 38 may be disposed directly within the cord management channel 28 at position along a length thereof.

In the preferred embodiment described herein, the multi-purpose mounting feature 22 has been described as extending continuously across the entire length of the rear side 20 of the luminaire 10. However, in another embodiment, the mounting feature 22 and the corresponding mounting and cord management channels 26 and 28 may extend only partially along the length of the rear side 20. Also, herein the cord management channel 28 has been described and shown as being disposed generally adjacent to the notch portion 36 of the mounting channel 26. See, e.g., FIG. 2. However, in another embodiment of the invention, the cord management channel 28 may be formed adjacent to the slot portion 34 of the mounting channel 26, or elsewhere within in the multi-purpose mounting feature 22 such that the channels 26 and 28 remain integral to one another, that is, the channels 26 and 28 remain at least partially continuous so that one may be accessed from the other, to thus simplify access and to simplify manufacturing and fabrication of the multi-purpose mounting feature and the corresponding luminaire.

As described hereinabove, in one embodiment of the invention, the cord management channel 28 is at least partly delimited by the protrusions a and b which extend along the entire length of the cord management channel 28. These protrusions a and b effectively separate the cord management channel 28 from the described mounting channel 26 and serve to retain the cord 24 within the cord management channel 28. This description is, of course, exemplary and is by no means limiting upon the broad scope of the invention. For example, in another embodiment, the protrusions a and b do not extend continuously along the entire cord management channel 28. That is, the protrusions a and b may only extend for a predetermined distance at, for example, a central region of the channel 28 thus leaving outer ends of the channel 28 open. Alternatively, two or more sets of the protrusions a and b may be arranged partially or entirely along the length of the cord management channel 28 creating a series of protruded sections and a corresponding series of open sections therebetween. Still further, the cord management channel 28 may include only the protrusion a extending continuously or periodically, entirely or partially along the length of the channel 28. To the contrary, the cord management channel 28 may include only the protrusion b extending continuously or periodically, entirely or partially along the length of the channel 28. In another configuration, the channel 28 may include both protrusions a and b but disposed offset from one another such that protrusion a extends for a length without the protrusion b, and then protrusion b extends for a length without the protrusion a, etc. These and other configurations of the protrusions a and b are contemplated by the invention in order to retain the cord 24 in the cord management channel 28 and to prevent any interference between the cord 24 and the mounting brackets 14 that are inserted into the associated mounting channel 26.

As also described herein above, the opening e formed by the protrusions a and b is described as being slightly smaller than the cross-sectional diameter of the cord 24. Also as described, the protrusions a and b and the surfaces c and d are arranged tangent to a circle equivalent in diameter to the cross-sectional diameter of the cord 24. In this way, the cord 24 may be press-fit into the cord management channel 28 and securely retained therein. This, of course, is a mere non-limiting exemplary embodiment of the invention.

In another embodiment of the invention, the opening e is at least equal to the cross-sectional diameter of the cord 24 and the surfaces of the cord management channel (e.g., a, b, c, etc.) are arranged generally tangent to a circle having a diameter greater than the cross-sectional diameter of the cord 24. To retain the cord 24 within the channel 28, this embodiment of the invention recognizes and utilizes the intrinsic deformation characteristics of electrical cords. It is well known that electrical cords routinely have a number of slightly deformed sections. For example, an electrical cord may have curved portions, or twisted portions, etc., which inhibit the cord from maintaining a perfectly straight orientation when unassisted. The effective cross-sectional diameter of such deformed cord, in this relaxed state (i.e., non-straightened), is greater than the actual cross-sectional diameter of the cord itself.

As mentioned, in this present embodiment the cross-sectional area provided by the cord management channel is greater than the actual cross-sectional diameter of the electrical cord 24. Preferably, the cross-sectional diameter of the channel 28 is less than or generally equivalent to the effective relaxed cross-sectional diameter of the cord 24. When this embodiment of the inventive luminaire is used, the cord 24 is substantially straightened and passed through the opening e into the cord management channel 28. Once inside the channel 28, internal deformation forces within the cord 24 seek to return cord 24 to its effective relaxed diameter (i.e., its normal curved, twisted, etc., position). These deformations forces cause portions of the cord 24 to bear against the interior of the channel 28 and thus result in the retention of the cord 24 within the channel 28. Here the cord 24 is not press-fit into a compressed or otherwise specifically held position within the channel 28. Instead, the cord 24 is simply made to bear against the internal surfaces of the cord management channel 28.

While the luminaire 10 has thus far been described as mountable on a partition panel typically used with modular office furniture, the invention contemplates the luminaire 10 being selectively and removably mountable on any vertical surface, such as a wall, etc., which is configured to receive the brackets 14. Additionally, while the invention addresses deficiencies in currently available panel-mounted luminaires such as those used with modular system partition panels included in modular office furniture system, the multi-purpose device may be used in other applications that require a flexible and adaptable mounting device as disclosed herein. For example, the invention may be employed in light industrial settings or anywhere requiring cord management and flexibility of installation and reposition. Additionally, there exist environments where cord management is not only an aesthetic issue, but where safety and contamination considerations must be addressed. For instance, it is foreseeable that electronic workstation components in a manufacturing or lab environment would benefit from the unique concealed cord management channel to secure cords or wires out of the way of a user's work area. Moreover, in addition to lighting, any fixture with a housing and profile configuration requiring an electrical power supply that is used in modular or repositionable forms, such as audio, computer, or control panel components, may utilize concealed cord management techniques of the current invention.

In sum, a mountable electronic device with an adaptable and unique electrical cord management system is provided herein. Particularly, a panel-mountable luminaire is provided that overcomes the disadvantages of the prior art and offers improved luminaire mounting and cord management capabilities. The luminaire of the invention includes a mounting feature that is flexible and adaptable to various modular designs, that is aesthetically pleasing to the user, that does not require excess accessory parts for cord management, and that maintains cost-effectiveness and ease of installation and reposition.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A luminaire, comprising:

a housing comprising a front side and an opposing rear side; and a multi-purpose mounting feature formed at an interior of the housing;

wherein the mounting feature is configured to receive and retain a mount for mounting of the luminaire on a vertical surface; and wherein the mounting feature is configured to receive and retain an electrical cord, wherein the mounting feature is configured to direct the electrical cord to extend generally horizontally and generally parallel to the rear side at least partially along a length of the luminaire, and wherein the mounting feature is configured to conceal the electrical cord from view.

2. The luminaire of claim 1, wherein the multi-purpose mounting feature comprises a mounting channel which receives and retains the mount, wherein the multi-purpose mounting feature further comprises a cord management channel which receives, retains, and directs the electrical cord in a concealed manner.

3. The luminaire of claim 2, wherein the mounting channel and the cord management channel are generally contiguous to one another and extend substantially parallel to one another.

4. The luminaire of claim 3, wherein the rear side is configured to be proximate to the vertical surface when the luminaire is mounted thereon, wherein the multi-purpose mounting feature opens to the rear side, and wherein the mounting channel and the cord management channel extend generally parallel to the rear side along the length of the luminaire.

5. The luminaire of claim 3, wherein a continuous common opening renders the mounting channel contiguous to the cord management channel, the opening being delimited by at least one protrusion of the interior of the luminaire which extends at least an entire length of the cord management channel.

6. The luminaire of claim 2, wherein the cord management channel is distinct from the mounting channel such that the electrical cord retained in the cord management channel bypasses the mount received and retained in the mounting channel.

7. The luminaire of claim 1, wherein the multi-purpose mounting feature comprises a channel formed into a rear side of the luminaire and an opening delimited by the rear side for allowing access to the channel, the channel and the corresponding opening extending substantially across the rear side of the luminaire, the channel being shaped to removably receive the mount and the electrical cord such that the mount does not interfere with the electrical cord directed along the length of the luminaire.

8. The luminaire of claim 1, wherein the mount received and retained in the multi-purpose mounting feature inhibits the luminaire from moving in directions perpendicularly away from the vertical surface, downwardly parallel to the vertical surface, and in directions therebetween.

9. The luminaire of claim 8, wherein the mount comprises an elongated neck portion, a bulbous portion at an end of the neck portion, and one or more hooks or flanges disposed opposite from the bulbous portion for affixing the mount to the vertical surface.

10. The luminaire of claim 1, wherein the multi-purpose mounting feature comprises an orifice which is formed into a rear side of the luminaire at an upward angle relative to the vertical surface, wherein the orifice is accessible at the rear side, and wherein the orifice extends substantial across a horizontal length of the rear side.

11. The luminaire of claim 10, wherein the orifice is delimited by internal surfaces of the luminaire including protrusions which releasably and lockingly engage the mount and the electrical cord, wherein the internal surfaces delimit a mounting channel for receiving and retaining the mount and a cord management channel for receiving, retaining, directing, and concealing the electrical cord, wherein the mounting channel and the cord management channel are distinct such that the mount disposed in the mounting channel does not obstruct the electrical cord directed along the length of the luminaire.

12. The luminaire of claim 2, wherein the electrical cord extends from the interior of the housing into the mounting channel and into the cord management channel which directs the electrical cord along the length of the luminaire adjacent to the mounting channel.

13. The luminaire of claim 5, wherein the opening has a cross-sectional area smaller than a cross-sectional area of the electrical cord, and wherein the electrical cord is compressible and resilient, wherein the electrical cord is fitted into the cord management channel by pressing the electrical cord into the opening in a direction generally perpendicular to a longitudinal axis of the electrical cord, wherein the cord compresses to pass through the opening and decompresses within the cord management channel to be retained therein.

14. The luminaire of claim 3, wherein the electrical cord is press fit into the cord management channel, wherein a cross-sectional diameter of the cord management channel is greater than a cross-sectional diameter of the electrical cord, and wherein deformation forces of the electrical cord bear the electrical cord against the cord management channel to retain the electrical cord therein.

15. The luminaire of claim 2, wherein the cord management channel is delimited by a plurality of surfaces of the interior of the luminaire, said surfaces being disposed to contact the electrical cord when received and retained in the cord management channel, wherein the plurality of surfaces are arranged generally tangent to a circular cross-section of the electrical cord.

16. The luminaire of claim 1, wherein the vertical surface comprises at least one of a wall, a partition, and an upright stanchion support member.

17. A method of mounting a luminaire on a vertical surface, the luminaire including a power cord extending therefrom and a housing comprising a front side and an opposing rear side, the method comprising:

disposing the power cord in a multi-purpose mounting feature formed at an interior of the luminaire to conceal the cord from view;

directing the power cord in a horizontal direction in the multi-purpose mounting feature along at least part of a length of the luminaire, said horizontal direction running generally parallel to the rear side;

affixing a plurality of mounting brackets onto the vertical surface; and inserting the mounting brackets into the multi-purpose mounting feature to support the luminaire;

wherein the multi-purpose mounting feature is configured such that the mounting brackets do not interfere with said directing of the power cord along the length of the luminaire.

18. The method of claim 17 further comprising, directing the power cord, at a cord drop location, out of the multi-purpose mounting feature and away from the luminaire.

19. The method of claim 17, wherein said disposing the cord in the multi-purpose mounting feature comprises pressing the power cord into a cord management channel in a direction generally perpendicular to a longitudinal axis of the power cord, the cord management channel being delimited within the multi-purpose mounting feature.

20. The method of claim 19, wherein said inserting the mounting brackets into the multi-purpose mounting feature comprises inserting the brackets into a mounting channel delimited within the multi-purpose mounting feature adjacent to the cord management channel, wherein the cord management channel and the mounting channel extend along the length of the luminaire generally parallel to one another and generally contiguous to one another.

* * * * *